US009021621B2

(12) United States Patent
Booker, Jr.

(10) Patent No.: US 9,021,621 B2
(45) Date of Patent: May 5, 2015

(54) DRAIN STRAINER AND FILTER

(76) Inventor: Sylvester R. Booker, Jr., Highland Springs, VA (US)

( * ) Notice: Subject to any disclaimer, the term of this patent is extended or adjusted under 35 U.S.C. 154(b) by 596 days.

(21) Appl. No.: 13/361,752

(22) Filed: Jan. 30, 2012

(65) Prior Publication Data

US 2013/0191982 A1 Aug. 1, 2013

(51) Int. Cl.

| | |
|---|---|
| ***E03C 1/26*** | (2006.01) |
| ***E03C 1/23*** | (2006.01) |
| ***E03C 1/264*** | (2006.01) |
| ***E03C 1/262*** | (2006.01) |

(52) U.S. Cl.
CPC ..... *E03C 1/2306* (2013.01); *E03C 1/264* (2013.01); *E03C 1/262* (2013.01)

(58) Field of Classification Search
USPC ..... 4/286–292, 295, 652
See application file for complete search history.

(56) References Cited

U.S. PATENT DOCUMENTS

| | | | | |
|---|---|---|---|---|
| 1,035,733 | A | 8/1912 | Pierce | |
| 2,505,305 | A | 4/1950 | Schaefer | |
| 4,207,631 | A | 6/1980 | Baggey | |
| 5,369,815 | A * | 12/1994 | Martin | 4/287 |
| 6,276,000 | B1 | 8/2001 | Saman et al. | |
| 6,387,261 | B1 | 5/2002 | Mojena | |
| D462,422 | S | 9/2002 | Conner | |
| 7,376,983 | B1 | 5/2008 | Sciarrino | |
| D604,800 | S | 11/2009 | Vreeland | |
| 2004/0073992 | A1 | 4/2004 | Saman et al. | |

FOREIGN PATENT DOCUMENTS

| | | |
|---|---|---|
| GB | 2079594 | 1/1982 |

OTHER PUBLICATIONS

Website, http://www.amazon.com/Kitchen-Bath-Sink-Strainer-Stopper/dp/B0012KCD70/ref=sr_1_8?s=home-garden&ie=UTF8& gid=1320595882&sr=1-8, Kitchen & Bath Sink Strainer With Stopper, one sheet printed from the internet on Nov. 7, 2011.

* cited by examiner

*Primary Examiner* — Tuan N Nguyen
(74) *Attorney, Agent, or Firm* — Richard C Litman

(57) ABSTRACT

The drain strainer and filter is removably placed within a sink, tub, or other drain to prevent solid particles from passing through the drain and building up to block the drain at some inaccessible location. The device includes a perforated basket having a removable perforated lid. The basket and lid enclose a removable and disposable filter element therein. The drain strainer may have a retractable stopper extending therebelow, the stopper being actuated by a lift rod that extends through the basket, filter, and lid. The handle of the lift rod may be removed to allow the lid and the filter to be removed from the basket. Alternatively, the drain strainer does not include the stopper. The drain strainer includes a folding handle. The lid includes a recess to allow the handle to fold flush with the top of the lid to avoid interference with articles in the sink during use.

16 Claims, 4 Drawing Sheets

DRAIN STRAINER AND FILTER

BACKGROUND OF THE INVENTION

1. Field of the Invention

The present invention relates generally to plumbing accessories and the like, and particularly to a drain strainer and filter for removable installation in various household and other drains.

2. Description of the Related Art

Drain strainers comprising baskets of perforated material for removable installation in kitchen and bathroom sink drains serve to prevent the blockage or clogging of such household drains with food, hair, and/or other solids. These strainers generally do a reasonably good job of retaining such solids to prevent their traveling farther down into the sink trap or other relatively inaccessible area, but the relatively large pores found in the typical sink strainer still allow a fair amount of particulate matter to flow through the perforations and into the trap, where they may build up.

In many cases a finer filtration system than the relatively porous sink drain basket is desirable. Accordingly, some devices for sink drains have been constructed to house a relatively fine mesh screen or other filter therein. While this serves the purpose of providing better filtration than the conventional porous basket, none of the sink filtration devices of which the client is aware include an adjustable drain stopper or plug with the device. A person using such a conventional drain filter must remove the filter and its housing from the drain to access the separate drain plug, to open or stop the drain as desired. Moreover, most such devices with relatively fine filters comprise metal screens or the like that must be cleaned and reused. Provision of a disposable fiber filter would greatly simplify the use of such a device.

Thus, a drain strainer and filter solving the aforementioned problems is desired.

SUMMARY OF THE INVENTION

The drain strainer and filter includes a porous basket and removable porous lid defining a filter housing therein. A flat filter is captured between upper and lower filter retainers and placed in the bottom of the basket. The lid is then secured over the filter. The filter is preferably formed of an economically disposable loosely woven fiber, such as cotton gauze or a loose Dacron® fill or the like. The lid includes a folding handle extending upward therefrom. The lid has a recess to allow the handle to fold flush with the upper surface of the lid to avoid interference with articles placed in the sink.

In a first embodiment, the drain strainer includes a retractable drain stopper extending below the basket. The stopper is raised and lowered by a vertical shaft that passes through the bottom of the basket, the filter and its retainer components, and the lid. The upper portion of the shaft is removable from the lower portion to allow the lid to be removed from the basket and to allow the filter and its retainers to be removed from the assembly. A second embodiment of the drain strainer does not include the stopper or its actuation shaft. However, the second embodiment does include a folding handle extending from the top of the lid to facilitate placement and removal of the strainer and filter in the drain.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The drain strainer and filter is a combination device providing relatively coarse straining or filtration of liquids flowing therethrough by means of the perforated basket and lid or cover, and finer filtration by means of the filter element within the basket. Embodiments include a device with an adjustable stopper, and a device without a stopper.

Figure 1:
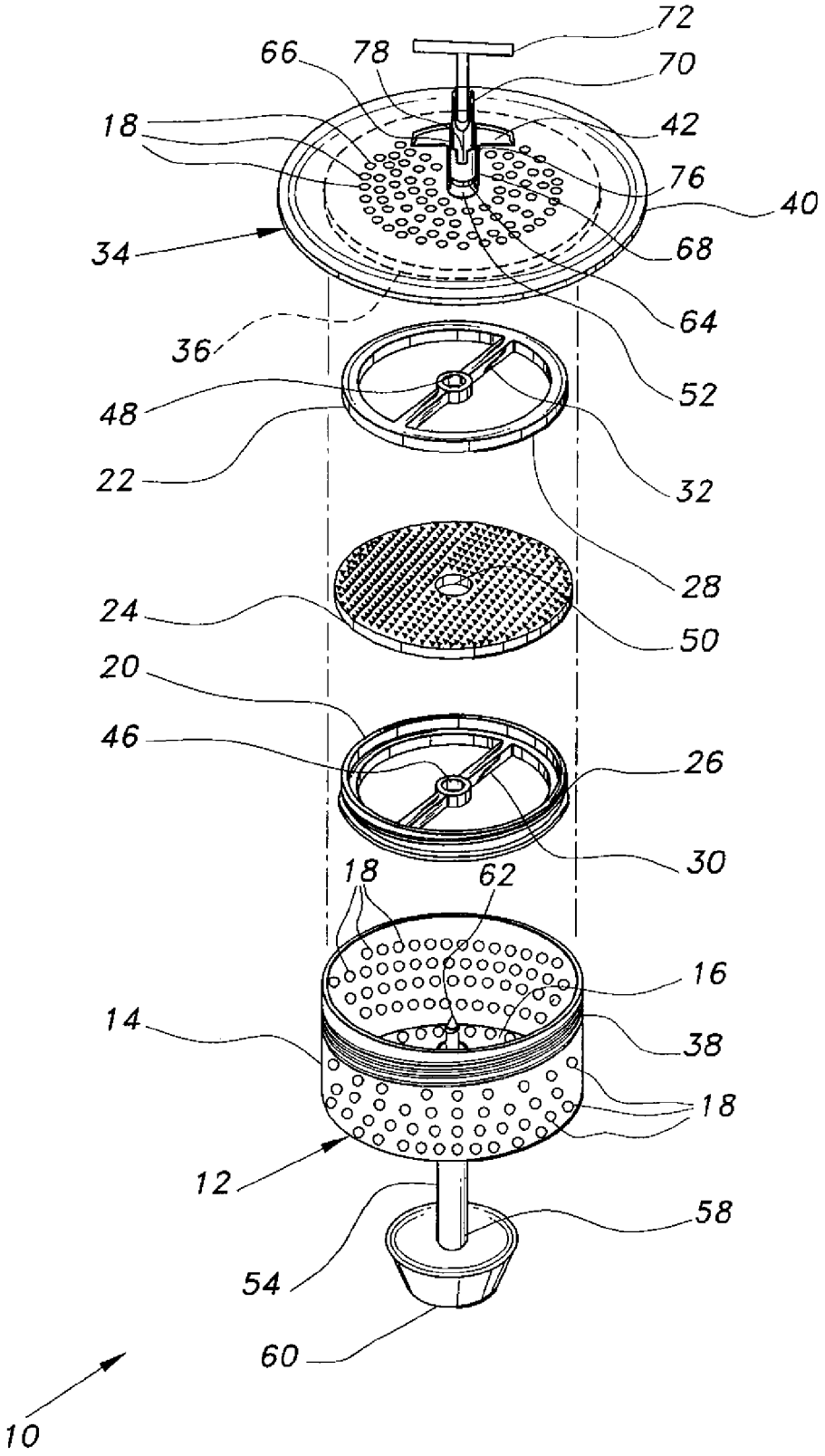
FIG. 1 is an exploded perspective view of a first embodiment of a drain strainer and filter according to the present invention, illustrating its various components.
Figure 2:
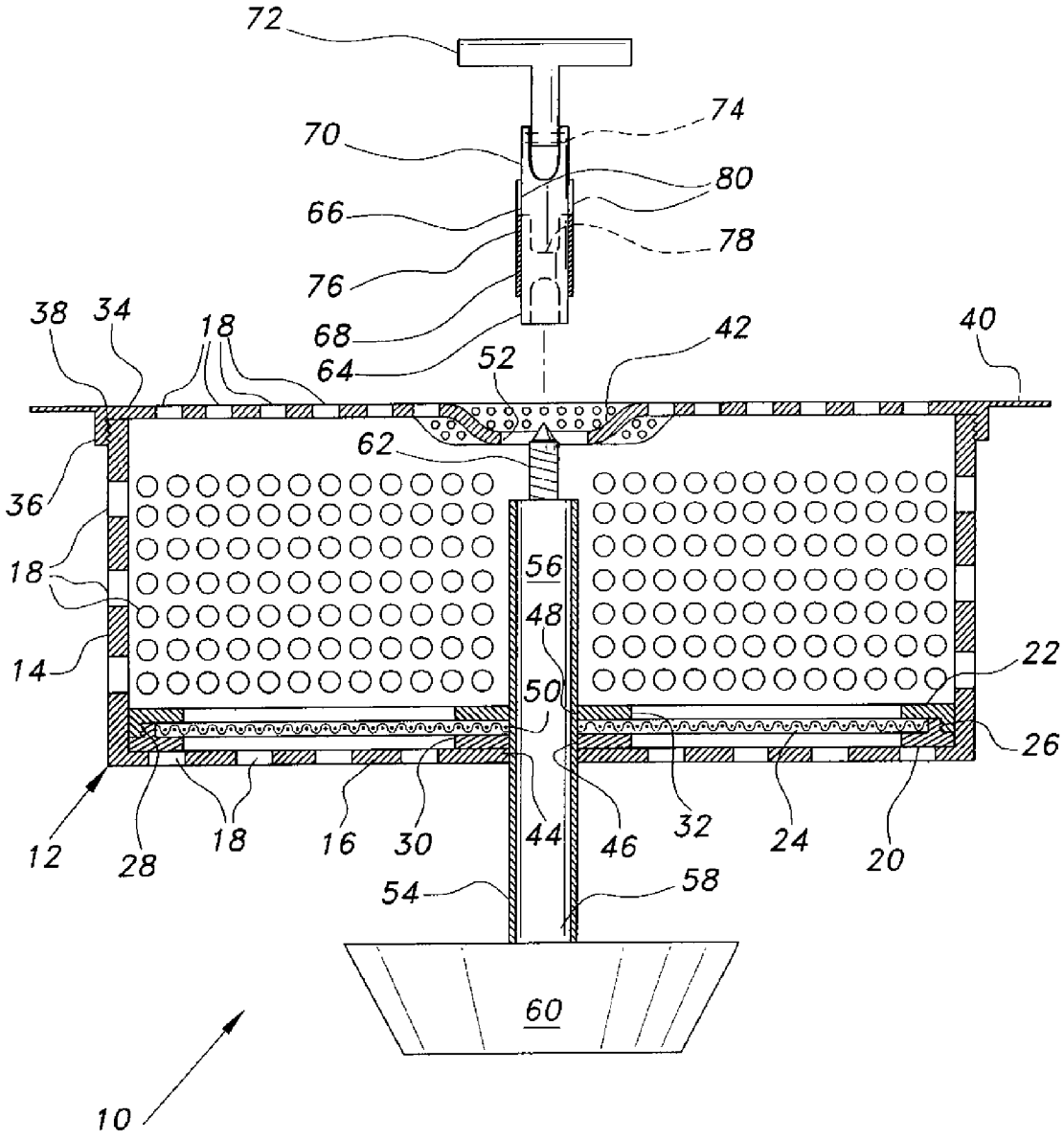
FIG. 2 is a side elevation view in section of the drain strainer and filter of FIG. 1, illustrating further details thereof.

FIGS. 1 and 2 of the drawings illustrate a first embodiment of the drain strainer and filter 10 having an adjustable stopper. The drain strainer and filter 10 comprises a basket 12 having a cylindrical side wall 14 and circular bottom 16, the side wall 14 and the bottom 16 having a large number of passages or perforations 18 therethrough.

A filter assembly is removably installed within the basket 12. The filter assembly comprises a lower filter retainer 20 and an upper filter retainer 22, and a filter element 24 captured therebetween. The filter element 24 is preferably formed of loosely woven natural or synthetic fiber material, e.g., cotton, Dacron®, etc. Other filter materials may be used, if suitable.

Each of the filter retainer components 20 and 22 has a generally open central area, as can be seen clearly in FIG. 1, and a circular rim 26, 28, respectively, dimensioned and configured to fit closely within the cylindrical wall 14 of the basket 12. The lower filter retainer 20 has an inset, externally threaded rim 26 extending upward therefrom, and the upper filter retainer 22 has an internally threaded rim 28 extending therefrom, as seen most clearly in FIG. 2. The two threaded rims 26 and 28 of the filter retainer components 20 and 22 thread cooperatively together to capture the filter element 24 removably therein. Each of the filter retainer components 20 and 22 further includes a diametric crossmember 30, 32, respectively, to provide further security for the filter 24 captured therebetween.

A lid 34 is provided for removable attachment to the basket 12. The lid 34 has an internally threaded basket attachment rim 36 that threads onto the corresponding externally threaded upper rim 38 of the basket 12. A flange 40 extends outward beyond the rim 36 of the lid 34 coplanar with the surface of the lid 34. The flange 40 provides a better seal about the periphery of the drain strainer and filter 10, serving to greatly reduce the amount of water and particles that may bypass the device 10 by flowing between the side of the basket 12 and the inner wall of the drain. The portion of the lid 34 within the rim 36 is provided with a large number of drain holes or perforations 18 similar to the perforations 18 of the basket wall 14 and bottom 16. The lid 34 also includes a handle clearance recess 42 therein to allow the T handle (discussed further below) to rest therein flush with the upper surface of the lid 34, as shown in the lid 134 of the embodiment of the drain strainer and filter shown in FIG. 4, in order to avoid interference with articles (e.g., dishware, etc.) in the sink when the drain strainer and filter 10 is removably installed in the sink drain.

The drain strainer 10 of FIGS. 1 and 2 includes a selectively retractable and extendable stopper assembly. The various components discussed to this point include passages therethrough for the stopper assembly. The bottom 16 of the basket 12 has a stopper rod passage 44 extending therethrough (shown in the side elevation view in section of FIG. 2). In addition, the diametric crossmembers 30 and 32 of the lower and upper filter retainers 26 and 28 have widened central areas to provide for their stopper rod passages 46, 48. The filter element 24 also includes a stopper rod passage 50 therethrough, and the lid 34 also has a stopper rod passage 52 extending therethrough.

A tubular stopper rod housing 54 is immovably affixed within the stopper rod passage 44 of the basket bottom 16. A stopper rod 56 is installed within the stopper rod housing 54, and is free to slide axially within the housing. The stopper rod 56 (shown in FIG. 2) has a stopper attachment end 58 and a stopper 60 attached thereto. The opposite handle assembly attachment end of the stopper rod comprises a threaded extension 62, which is removably attached to the mating internally threaded stopper rod attachment end 64 of the handle extension rod 66 of the handle assembly.

The handle extension rod 66 is free to slide axially within a handle extension housing 68. The handle extension rod 66 has a handle attachment end 70 opposite its stopper rod attachment end 64. A T handle 72 is pivotally secured to the handle attachment end 70 of the handle extension rod 66 by a pivot pin 74. The T handle 72 is used to lift and turn the handle extension rod 66, along with the stopper rod 56 and its stopper 60, to lift and hold the stopper 60 clear of the underlying drain or to allow the stopper 60 to drop into the drain to close the drain, as desired. The upper end 76 of the handle extension housing 68 includes at least one (and preferably two opposed) slot(s) 78 therein, and the handle extension rod 66 has a corresponding shoulder or shoulders 80 disposed along the sides thereof. This construction results in the handle extension rod 66 being held in an upper position when its shoulders 80 are resting atop the higher end 76 of the handle extension housing 68, as shown in FIG. 2 of the drawings. This will be seen to raise the attached stopper rod 56 when the removable handle assembly is attached thereto, so that the stopper 60 is lifted accordingly to open the underlying drain when the drain strainer and filter 10 is installed in a sink, tub, or the like. When it is desired to close the drain, the T handle 72 may be turned to allow the shoulder(s) 80 of the handle extension rod 66 to drop down into the corresponding slot(s) 78 of the handle extension housing 68, thereby allowing the attached stopper rod 56 and its stopper 60 to drop down to seal the underlying drain. The T handle 72 may be pivoted downward to lie within the handle clearance recess 42 of the lid 34 to preclude interference with articles in the sink, generally as shown in the embodiment of FIGS. 3 and 4.

Figure 3:
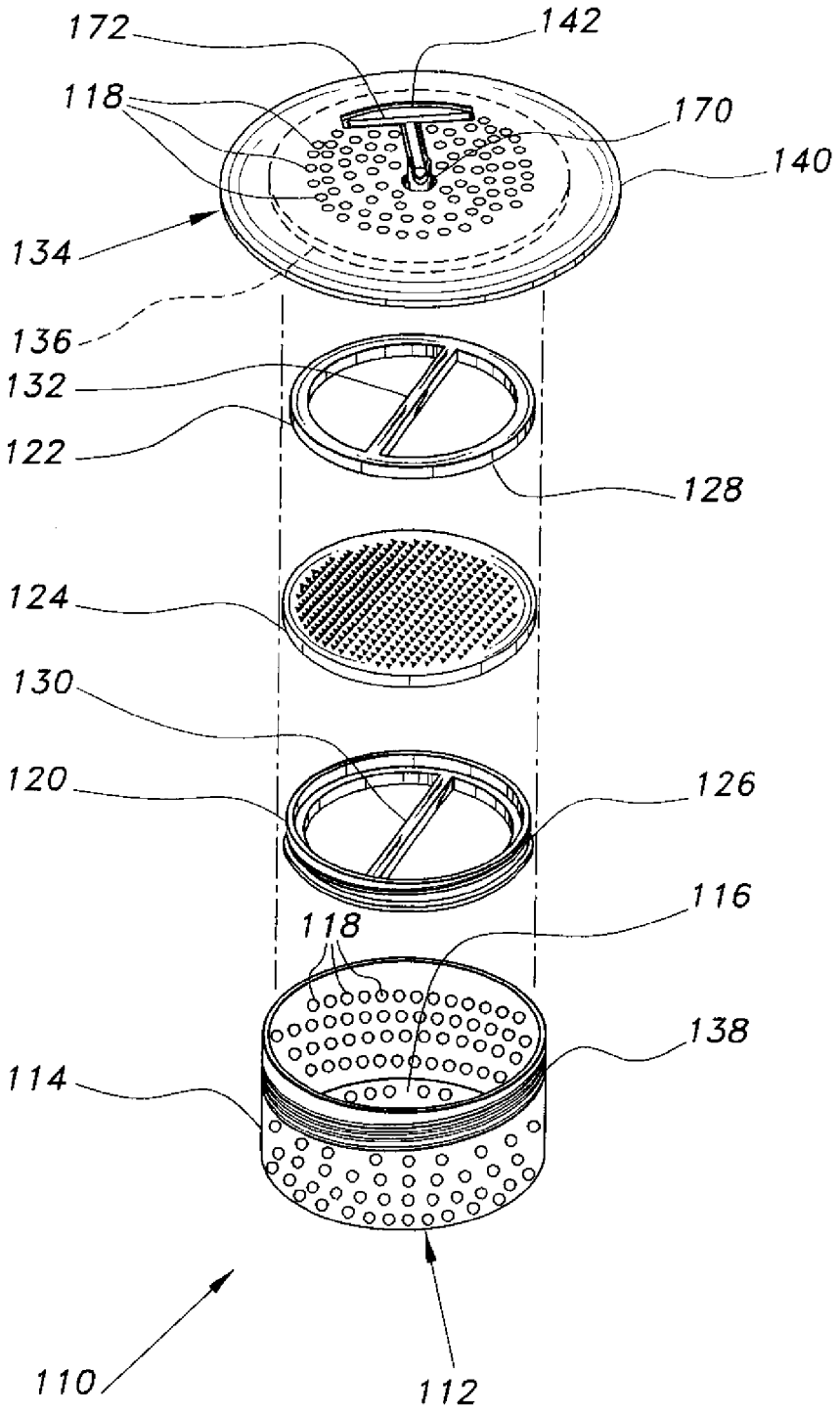
FIG. 3 is an exploded perspective view of a second embodiment of a drain strainer and filter according to the present invention, illustrating its various components.
Figure 4:
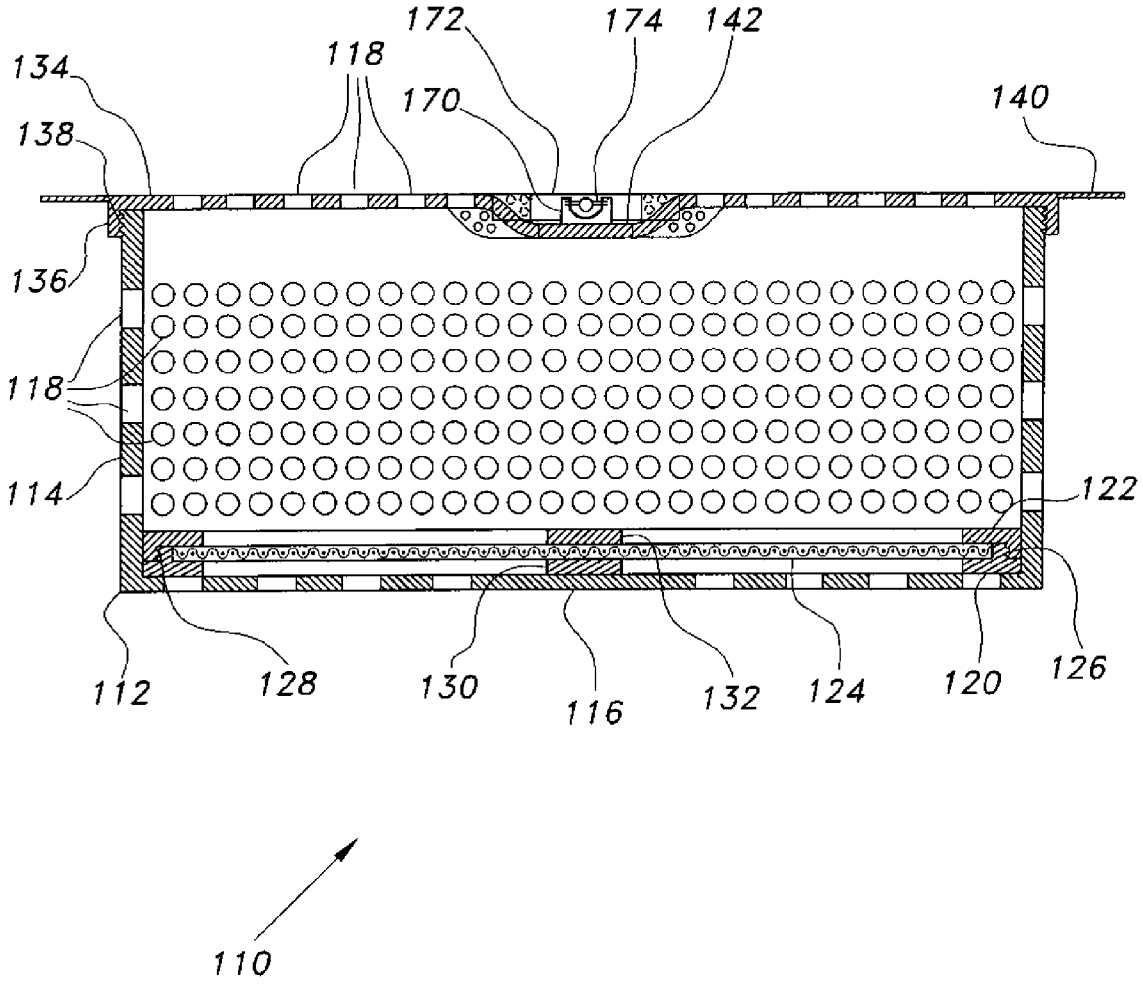
FIG. 4 is a side elevation view in section of the drain strainer and filter of FIG. 3, illustrating further details thereof.

FIGS. 3 and 4 illustrate a drain strainer and filter 110 that does not include the retractable stopper mechanism of the embodiment 10 illustrated in FIGS. 1 and 2. The components of the second embodiment drain strainer and filter 110 of FIGS. 3 and 4 are designated by three digit reference numerals, with corresponding components of the two embodiments having identical numerals in their last two digits. Accordingly, the drain strainer and filter 110 comprises a basket 112 having a cylindrical side wall 114 and circular bottom 116, the side wall 114 and bottom 116 having a large number of passages or perforations 118 therethrough. It will be noted that there is no central passage through the bottom 116 of the basket 112 of the drain strainer 110 of FIGS. 3 and 4 due to the lack of the stopper rod assembly in the drain strainer 110.

The filter assembly of the drain strainer 110 of FIGS. 3 and 4 comprises lower and upper filter retainers, respectively 120 and 122, and a filter element 124 captured therebetween. Each of the filter retainer components 120 and 122 has a generally open central area, as can be seen clearly in FIG. 3, and a circular rim 126, 128 dimensioned and configured to fit closely within the cylindrical wall 114 of the basket 112. The lower filter retainer 120 has an inset, externally threaded rim 126 extending upward therefrom, and the upper filter retainer 122 has an internally threaded rim 128 extending therefrom, as seen most clearly in FIG. 4. The two threaded rims 126 and 128 of the filter retainer components 120 and 122 thread cooperatively together to capture the filter element 124 removably therein in a manner essentially identical to that of the drain strainer 10 of FIGS. 1 and 2. Each of the filter retainer components 120 and 122 further includes a diametric crossmember 130, 132 to provide further security for the filter 124 captured therebetween. However, it will be noted that the diametric crossmembers 130 and 132 have constant widths and do not have the wider central areas of the crossmembers 30 and 32 of the filter retainers 20 and 22 of FIGS. 1 and 2, as such wider central areas are not needed due to the lack of stopper rod passages in this embodiment of the drain strainer 110. Similarly, the filter element 124 is also devoid of a central passage therethrough.

A lid 134 is provided for removable attachment to the basket 112. The lid 134 has an internally threaded basket attachment rim 136 that threads onto the corresponding externally threaded upper rim 138 of the basket 112, as in the case of the drain strainer 10 of FIGS. 1 and 2. A flange 140 extends outward beyond the rim 136 of the lid 134 coplanar with the surface of the lid 134. The portion of the lid 134 within the rim 136 is provided with a large number of drain holes or perforations 118, in the manner of the perforations 18 and 118 of the respective basket walls 14 and 114 and bottoms 16 and 116.

Although the lid 134 of the embodiment 110 of FIGS. 3 and 4 is not provided with a stopper rod passage, it does include a pivotally folding T handle 172, similar to the T handle 72 of the embodiment 10 of FIGS. 1 and 2. However, the lower stem of the T handle 172 attaches to a short handle attachment fitting 170 by means of a pivot pin 174, the handle attachment fitting 170 being secured directly to the lid 134, rather than having the handle extend from the upper or handle attachment end of the handle extension rod, as in the drain strainer 10 of FIGS. 1 and 2. Accordingly, the lid 134 includes a handle clearance recess 142 therein to allow the T handle 172 to rest therein flush with the upper surface of the lid 134 in order to avoid interference with articles (e.g., dishware, etc.) in the sink when the drain strainer and filter 110 is removably installed in the sink drain.

Either embodiment of the drain strainer 10 or 110 may be used to capture both relatively large and smaller solid particles to prevent them from entering the drain and building up to cause an obstruction at some inaccessible location in the drain line. Both embodiments of the drain strainer 10, 110 may be made from a variety of materials, corrosion resistant steel (i.e., "stainless' steel) or plated steel being a desirable material. Other metals, or even plastics, may be used for any or all of the components other than the filter.

The drain strainer 10, 110 is readied for use by installing an appropriate filter 24 or 124 within the corresponding filter retainer components, and placing the filter and retainer assembly within the bottom of the corresponding basket 12 or 112. The lid 34 or 134 is then installed upon the upper rim of its basket 12 or 112. If the drain strainer 10 of FIGS. 1 and 2 is to be used, the stopper rod 56 is installed through the stopper rod housing 54 extending through the bottom 16 of the basket 12, and the handle assembly (comprising the handle extension housing 68, handle extension rod 66, and T handle 72 pivotally attached thereto) is threaded onto the handle assembly attachment end 62 of the stopper rod 56 to complete the assembly. The drain strainer 10, 110 is disassembled for cleaning and replacement of the disposable filter element therein after use, essentially by reversing the above-described assembly procedures.

It is to be understood that the present invention is not limited to the embodiments described above, but encompasses any and all embodiments within the scope of the following claims.

I claim:

1. A drain strainer, comprising:

a perforated basket having a circular bottom and a cylindrical side wall extending from the circular bottom, wherein the cylindrical side wall has an externally threaded upper rim; and a filter assembly disposed in the basket, having:

a lower filter retainer having an open center and a circular rim fitting closely within the basket;

an upper filter retainer having an open center and a circular rim fitting closely within the basket, the upper filter retainer being removably attached to the lower filter retainer;

a filter element removably captured between the lower filter retainer and the upper filter retainer, the filter element being fitting closely within the lower filter element and the upper filter element; and a perforated lid adapted for removable attachment to the basket, the lid having a handle clearance recess defined therein, wherein the lid has an internally threaded rim removably attachable to the upper rim of the basket, the lid further including a flange extending outward therefrom and coplanar therewith.

2. The drain strainer according to claim 1, wherein the bottom of the basket has a stopper rod passage extending therethrough, the drain strainer further comprising:

a stopper rod assembly having:

a stopper rod housing disposed through the stopper rod passage of the bottom of the basket, the stopper rod housing being permanently and immovably affixed to the bottom of the basket;

a stopper rod disposed within the stopper rod housing, the stopper rod being axially slidable within the stopper rod housing, the stopper rod having a stopper attachment end and a handle assembly attachment end opposite the stopper attachment end; and a stopper affixed to the stopper attachment end of the stopper rod; and a handle assembly removably attached to the handle attachment end of the stopper rod, the handle assembly having:

a handle extension housing;

a handle extension rod having a stopper rod attachment end and a handle attachment end opposite the stopper rod attachment end, the handle extension rod being axially slidable within the handle extension housing, the handle extension rod being removably attached to the stopper rod; and a T handle pivotally secured to the handle attachment end of the handle extension.

3. The drain strainer according to claim 2, wherein:

the handle extension housing has an upper end having at least one notch disposed therein; and the handle attachment end of the handle extension rod has at least one shoulder extending radially therefrom, the shoulder selectively dropping into the notch in the handle extension housing for lowering the handle extension rod and the stopper rod and the stopper attached thereto.

4. The drain strainer according to claim 1, wherein the filter element is formed of loosely woven fiber materials selected from the group consisting of natural fibers and synthetic fibers.

5. The drain strainer according to claim 1, wherein at least the basket is formed of a material selected from the group consisting of metal and plastic.

6. A drain strainer, comprising:

a perforated basket having a circular bottom and a cylindrical side wall extending from the circular bottom wall, the bottom having a stopper rod passage extending therethrough;

a. perforated lid removably attachable to the basket, the lid having a handle clearance recess disposed therein;

a stopper rod assembly, having:

a stopper rod housing disposed through the stopper rod passage in the bottom of the basket, the stopper rod housing being permanently and immovably affixed to the bottom of the basket;

a stopper rod disposed within the stopper rod housing, the stopper rod being axially slidable within the stopper rod housing, the stopper rod having a stopper attachment end and a handle assembly attachment end opposite the stopper attachment end; and a stopper affixed to the stopper attachment end of the stopper rod; and a handle assembly removably attached to the handle attachment end of the stopper rod, the handle assembly having:

a handle extension housing;

a handle extension rod having a stopper rod attachment end and a handle attachment end opposite the stopper rod attachment end, the handle extension rod being axially slidable within the handle extension housing, the handle extension rod being removably attached to the stopper rod; and a T handle pivotally secured to the handle attachment end of the handle extension.

7. The drain strainer according to claim 6, wherein:

the handle extension housing has an upper end having at least one notch disposed therein; and the handle attachment end of the handle extension rod has at least one shoulder extending radially therefrom, the shoulder selectively dropping into the notch in the handle extension housing for lowering the handle extension rod and the stopper rod and the stopper attached thereto.

8. The drain strainer according to claim 6, further comprising a filter assembly having:

a lower filter retainer having an open center and a circular rim fitting closely within the basket;

an upper filter retainer having an open center and a circular rim fitting closely within the basket, the upper filter retainer being removably attached to the lower filter retainer; and a filter element removably captured between the lower filter retainer and the upper filter retainer, the filter element fitting closely within the lower filter element and the upper filter element.

9. The drain strainer according to claim 8, wherein the filter element is formed of loosely woven fiber materials selected from the group consisting of natural fibers and synthetic fibers.

10. The drain strainer according to claim 6, wherein:

the side wall of the basket has an externally threaded upper rim; and the lid has an internally threaded rim removably attachable to the upper rim of the basket, the lid further including a flange extending outward therefrom and coplanar therewith.

11. The drain strainer according to claim 6, wherein at least the basket, the stopper rod assembly, and the handle assembly are formed of a material selected from the group consisting of metal and plastic.

12. A drain strainer, comprising:

a perforated basket having a circular bottom and a cylindrical side wall extending upward from the circular bottom, wherein the side wall of the basket includes an externally threaded upper rim; and a perforated lid removably attached to the basket, the lid having a handle clearance recess defined therein, wherein the lid includes an internally threaded rim mating with the upper rim of the basket, the lid having a flange extending outward therefrom and coplanar therewith.

13. The drain strainer according to claim 12, further comprising a filter assembly disposed in the basket, the filter assembly having:

a lower filter retainer having an open center and a circular rim fitting closely within the basket;

an upper filter retainer having an open center and a circular rim fitting closely within the basket, the upper filter retainer being removably attached to the lower filter retainer; and a filter element removably captured between the lower filter retainer and the upper filter retainer, the filter element fitting closely within the lower filter element and the upper filter element.

14. The drain strainer according to claim 13, wherein:

the filter element is formed of loosely woven fiber materials selected from the group consisting of natural fibers and synthetic fibers; and at least the basket, and the lid are formed of a material selected from the group consisting of metal and plastic.

15. The drain strainer according to claim 12, wherein the bottom of the basket has a stopper rod passage extending therethrough, the drain strainer further comprising:

a stopper rod assembly, having:

a stopper rod housing extending through the stopper rod passage in the bottom of the basket, the stopper rod housing being permanently and immovably affixed to the bottom of the basket;

a stopper rod disposed within the stopper rod housing, the stopper rod being axially slidable within the stopper rod housing, the stopper rod having a stopper attachment end and a handle assembly attachment end opposite the stopper attachment end; and a stopper affixed to the stopper attachment end of the stopper rod; and a handle assembly removably attached to the handle attachment end of the stopper rod, the handle assembly having:

a handle extension housing;

a handle extension rod having a stopper rod attachment end and a handle attachment end opposite the stopper rod attachment end, the handle extension rod being axially slidable within the handle extension housing, the handle extension rod being removably attached to the stopper rod; and a T handle pivotally secured to the handle attachment end of the handle extension.

16. The drain strainer according to claim 15, wherein:

the handle extension housing has an upper end having at least one notch disposed therein; and the handle attachment end of the handle extension rod has at least one shoulder extending radially therefrom, the shoulder selectively dropping into the notch in the handle extension housing for lowering the handle extension rod and the stopper rod and the stopper attached thereto.

* * * * *